US005970657A

United States Patent [19]

Glass

[11] Patent Number: 5,970,657

[45] Date of Patent: Oct. 26, 1999

[54] SELF CLOSING SLIDING ACCESS DOOR

[75] Inventor: Roger Glass, Naperville, Ill.

[73] Assignee: Ready Access, Inc., Naperville, Ill.

[21] Appl. No.: 09/000,019

[22] PCT Filed: May 23, 1996

[86] PCT No.: PCT/US96/07392

§ 371 Date: Jan. 23, 1998

§ 102(e) Date: Jan. 23, 1998

[87] PCT Pub. No.: WO97/44232

PCT Pub. Date: Nov. 27, 1997

[51] Int. Cl.[6] ..... E05B 15/06

[52] U.S. Cl. ..... 49/231; 49/228

[58] Field of Search ..... 49/226, 228, 231, 49/263, 266, 272, 273, 274, 379

[56] References Cited

U.S. PATENT DOCUMENTS

| | | | |
|---|---|---|---|
| 2,989,302 | 6/1961 | Clark | 49/231 X |
| 3,074,124 | 1/1963 | Bergstedt | 49/231 |
| 3,805,450 | 4/1974 | Forcina | 49/231 |
| 4,646,471 | 3/1987 | Shaiu | 49/231 |
| 5,165,142 | 11/1992 | Pilsbury | 49/226 X |
| 5,572,830 | 11/1996 | Freeman | 49/273 |

*Primary Examiner*—Jerry Redman

*Attorney, Agent, or Firm*—Dvorak & Orum

[57] ABSTRACT

The present invention is directed to an automatically closing and locking door adapted for use in drive through and walk up facilities. The door rides on an inclined track and closes due to gravity. The door locks automatically upon the coupling of a hooked door latch with a cooperative hooked door base. The door is unlocked and opened by application of a lateral force upon the knob of the hooked door latch. A spring attached to the foot of the base is caused to exert a force against the door thereby coupling the hooked door latch and hooked door base.

9 Claims, 5 Drawing Sheets

SELF CLOSING SLIDING ACCESS DOOR

BACKGROUND OF THE INVENTION

The present invention is directed generally to an automatic door adapted for retail sales of products through a driveup door. Particularly, the present invention relates generally to automatic door closers of the inclined track type. This invention relates to serving doors, and more particularly, to serving doors and similar openings installed in drive through or walkup facilities such as fast food restaurant to facilitate exchange between a customer and the business without exposing the server or the interior space unnecessarily to inclement weather, insects, and other such problems. Such doors are usually mounted in the wall of a facility at a height which will put the server in convenient reaching distance from a customer seated in a vehicle, and are commonly used for fast food restaurants and other businesses with drive through service.

BRIEF DESCRIPTION OF THE PRIOR ART

Automatically actuated door arrangements have been known in use ill the past. Usually, these devices have relied on the application of a physical force to mechanically slide open the doors. Others utilize swinging doors which pivot outwards. Still others utilize magnetic materials to actuate movement of the doors.

However, problems have been encountered with certain aspects of the prior art devices. The present invention is drawn to an automatic sliding door on an inclined plane operated under the effects of gravity in combination with a self locking device.

BRIEF SUMMARY OF THE INVENTION

The nature of the invention is a door which rides on an inclined track so that it closes due to gravity by sliding down the inclined track. The door locks automatically when closed by the coupling of a hooked door latch with a cooperative hooked base latch.

The door opens by a lateral force being applied to the door latch thereby disengaging the locking means and providing for the sliding of the door up the inclined track. The door travels the distance up the inclined track commensurate with the degree of force supplied to it. Upon release, the door slides down the inclined track under the force of gravity. The door then meets a stopping point and reengages with the locking means to lock closed once again.

The purpose of the single sliding access door is to provide a self closing and self locking door for use in the fast food industry to free the hands of the employee to handle the objects being passed through the opening of the door and to provide for safe, effective, and absolutely positive closing of the door area without any input from the operator.

An object of the invention is to provide an automatic closing door which does not utilize electrical energy.

A further object of the invention is to provide a self closing door to free the operator to do other things and to assure closure of the door without operator input.

A further object of the invention is to provide a self locking door to free the operator to do other things and for better security.

DETAILED DESCRIPTION OF THE DRAWINGS

DETAILED DESCRIPTION OF THE INVENTION

Figure 1:
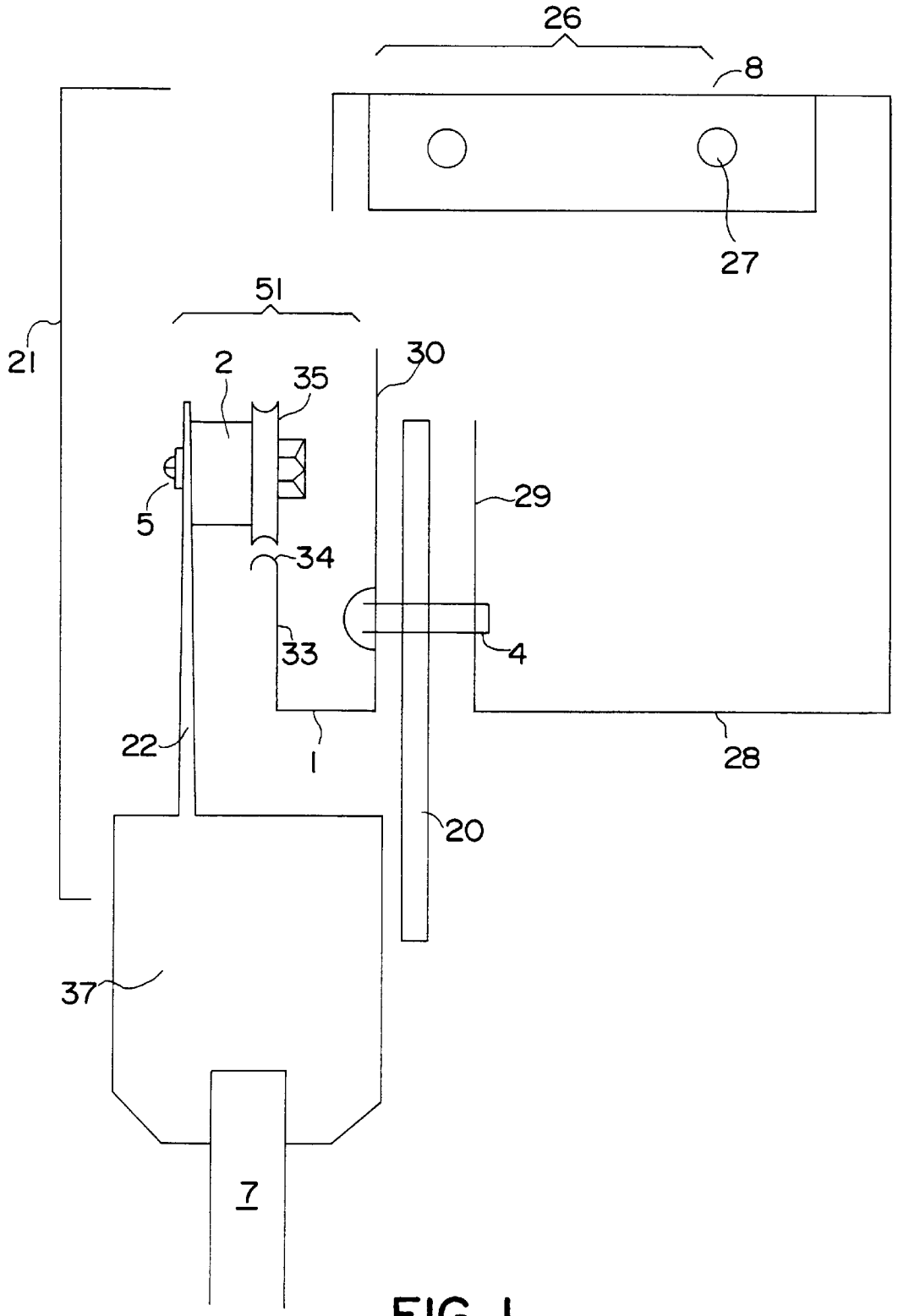
FIG. 1 is a cross section of the header, track, and door of the invention.
Figure 2:
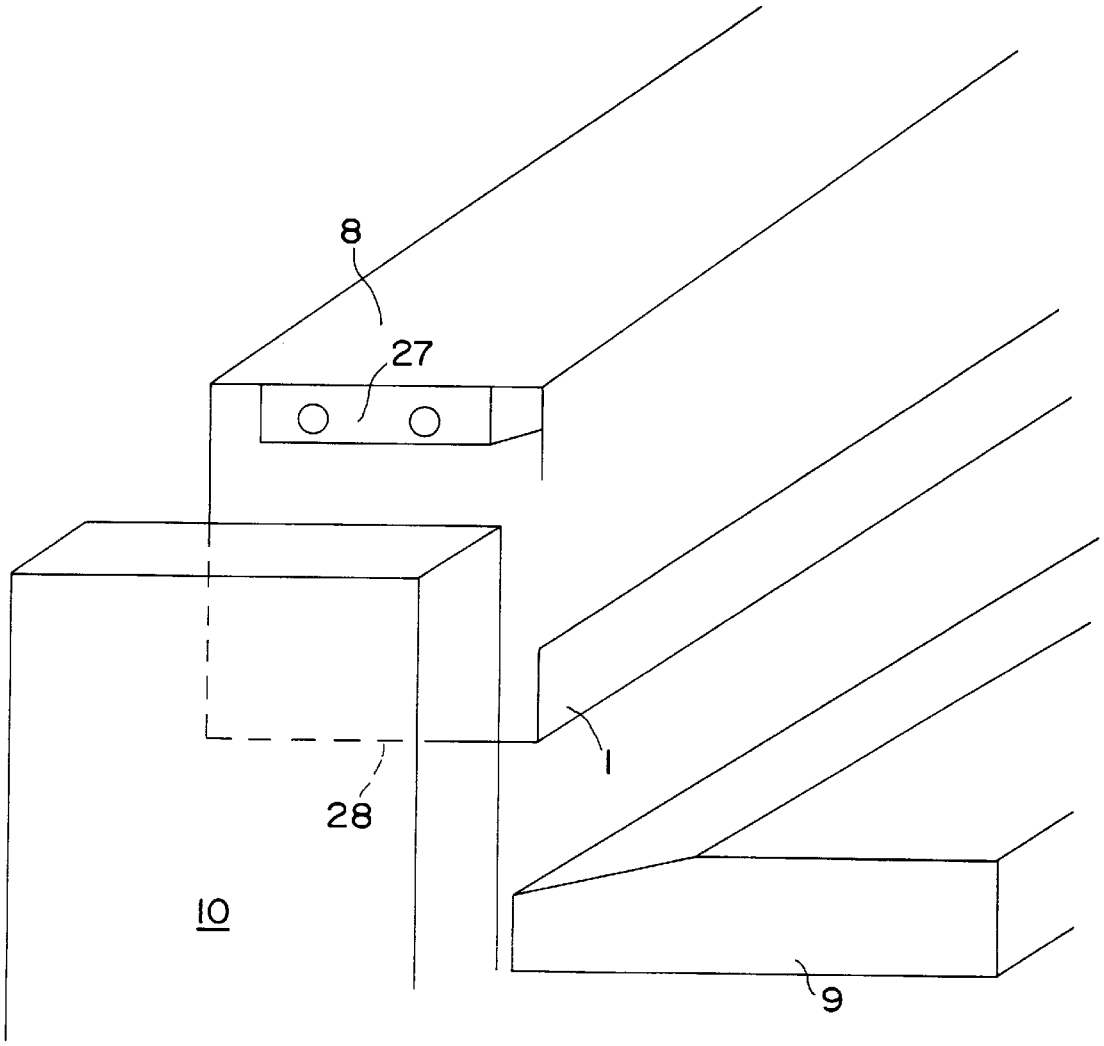
FIG. 2 is an enlarged view of the header, sill, and side frame of the invention.
Figure 7:
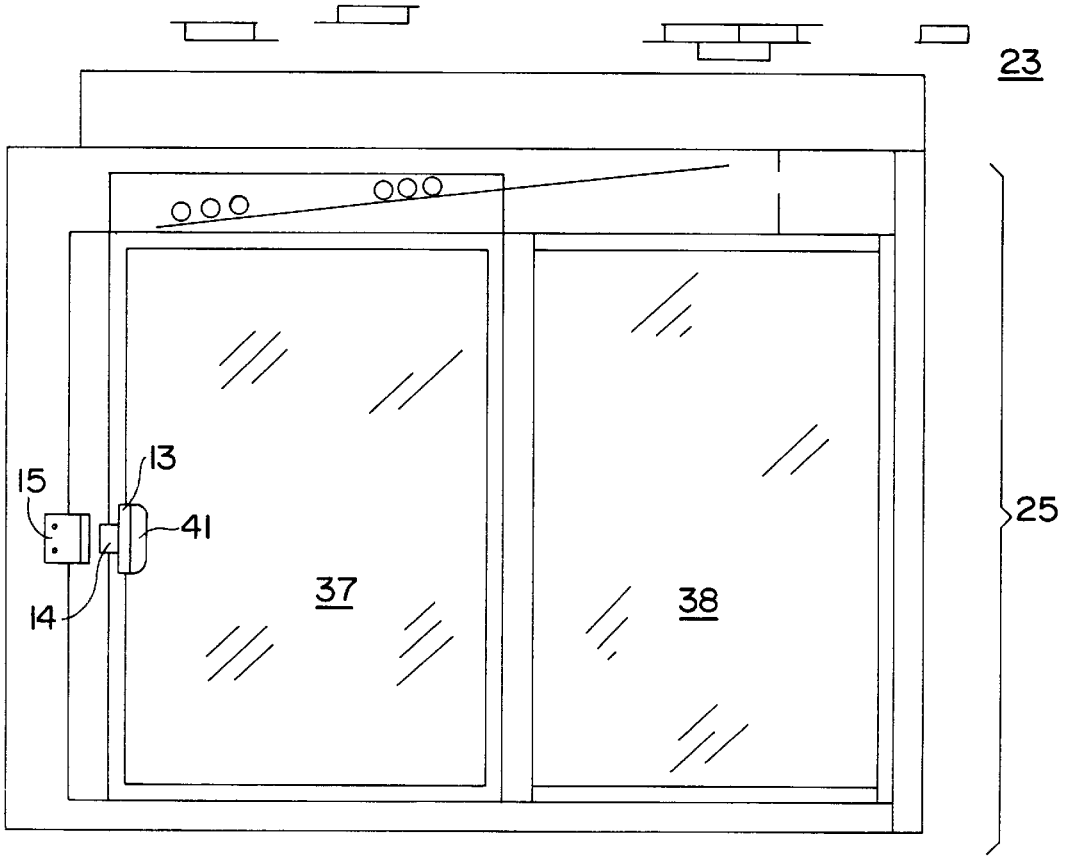
FIG. 7 is a front view of the invention in the latched position.

FIG. 7 illustrates an access door (7) attached to a wall (23). The door (7), as shown in FIG. 1, has a mounting flange (22), protruding from the top of the door. The mounting flange (22) is a long slender protrusion from the door (7) utilized in attaching the door (7) to the roller block (2) which rides oil a "G" shaped track (1). The "G" shaped track (1) is mounted inside the wall (23) wherein the access door assembly (25) is to be installed. The track and header complex (26) are installed within an opening of corresponding size made in the wall (23) for installation of the access door assembly (25). The header (8), as shown in FIG. 2, is attached to the upper wall (23) via a plurality of header attachment means (27). The header (8) is a generally "U" shaped member. The bottom horizontal leader (leader bottom) (28) is in contact with the sill (9) of the window (7). In one embodiment, the sill (9) is sloped at a 7A angle. The indoor header flange (29) is attached via a pop rivet (4) to the verticle track flange (30). All insulator (20) is fixedly mounted between the inner side of the indoor leader flange (29) and the outer side of the verticle track flange (30) via the pop rivet (4). The track roller support (33) of the track (1) has a convex track roller support surface (34) upon which a concave roller (34) sits. The track, in order to allow for closing due to gravity, is at an inclined angle.

The roller block assembly (51) consists of a roller block (2) and a concave roller (35) sitting in cooperation upon the convex track roller support surface (34) of the track (1). The roller block (2) is attached via an adjustment screw means (5) through the axis of the roller block (2) to the mounting flange (22) protruding from the door (7). The adjustment screw means (5) holds the mounting flange (22) to the roller block (2) and concave roller (35) in a manner to allow free rotation of the concave roller (35) about its axis. A cover (21) is located oil the inside of the area where the access door assembly (25) is installed as shown in FIG. 1. The cover (21) is attached to the wall (23) so as to prevent interference with the roller block assembly (51) and track (1) mechanism.

Figure 3:
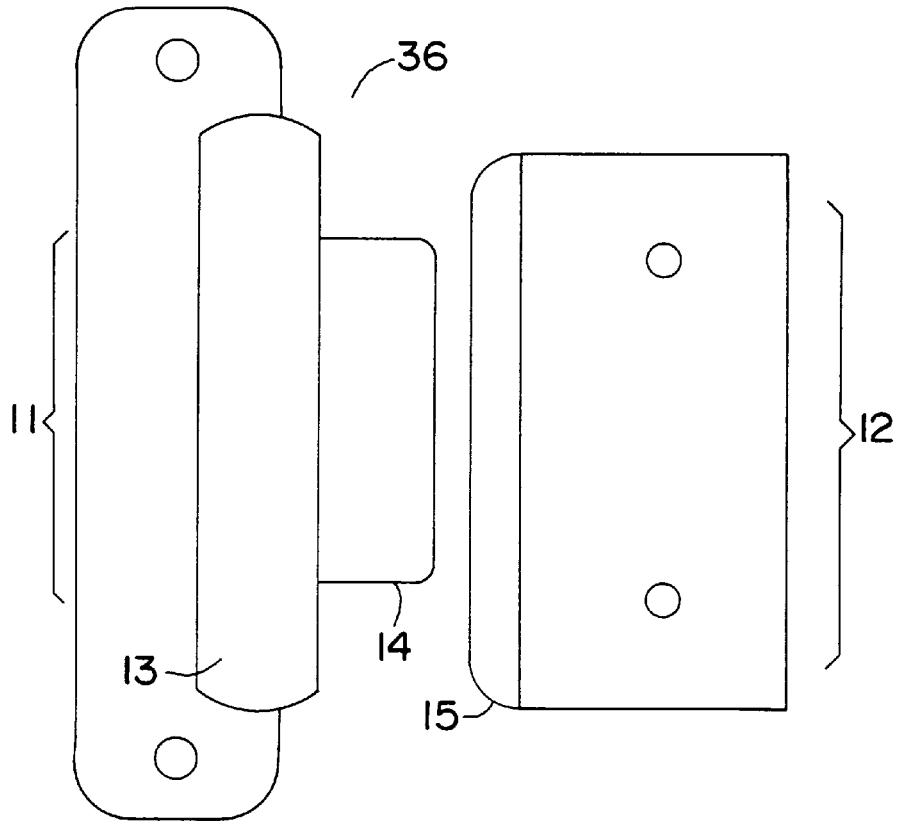
FIG. 3 is a front view of the latching mechanism.

FIG. 3 depicts the lock mechanism (36). The lock mechanism (36) consists of a door latch (11) attached to a door (37) as shown in FIG. 7 and a base latch (12) attached to a stationary wall (23).

Figure 4:
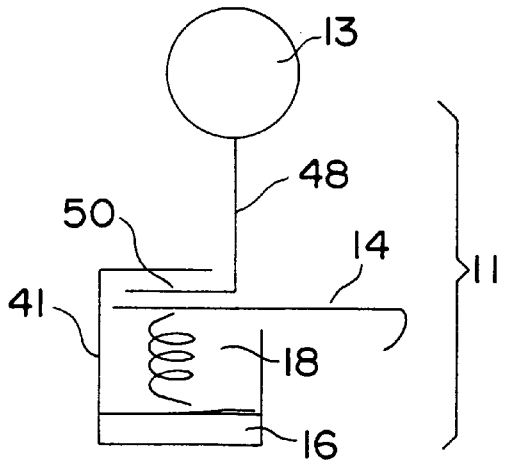
FIG. 4 is a top view of the door latch.

The door latch (11) consists of a knob (13) upon which an operator of the door exerts a lateral force to open the access door assembly (25). In the closed and locked position, the door grip (14) of the door latch (11) is engaged with the base grip (15) of the base latch (12). The door grip (14) is lip shaped. The door latch (11) is attached to the door (7) at the door stand (16). The door stand (16) is attached to the door (37) by an attachment means. As shown in FIG. 4, in one embodiment, the door latch (11) consists of a rectangular box-shaped body (41) with an opening (42) located opposite to the knob (13).

As shown in FIG. 3, the base latch (12) is a flat generally rectangular shape with a base grip (15) at one end. The base grip (15) is shaped like a lip which protrudes from the base latch (12) and is cooperative with the door grip (14) of the door latch (11). The base latch (12) is attached to the fixed wall (23) via an attachment means.

Figure 5:
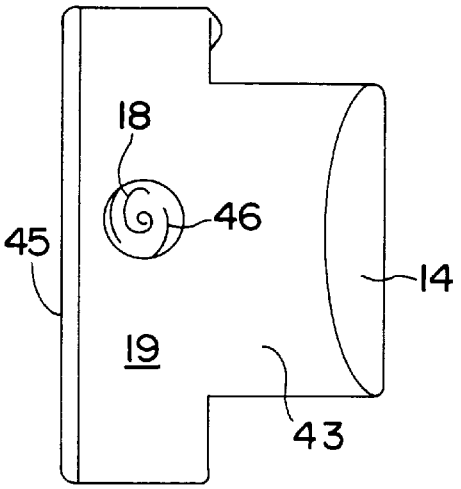
FIG. 5 is a side view of the latch plate of the door latch.

The door grip (14) is removable from within the door latch (11) via the opening (42) in the door stand (16). As shown in FIG. 5, the door grip (14) consists of a generally rectangular door grip base (19) from which protrudes the door grip (14) shaped like a lip. The lip of the door latch (11) is curled toward the door (7). The door latch (11) has a door grip extension (43) between the door grip (14) and the door grip base (19). A door grip base flange (45) protrudes toward the door (7) oil the top side of the door latch (11). A spring (18) for biasing the lips of the door latch (11) and base latch (12) open and closed is located generally in the center of the door grip base (19) and is attached by a spring attachment means (46).

Figure 6:
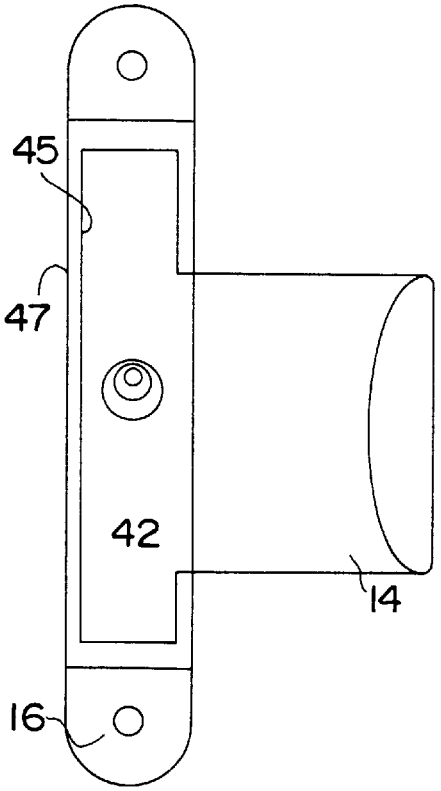
FIG. 6 is a rear view of the door latch.

As shown in FIG. 6, when the door grip (14) is contained within the body (41) of the door latch (11), the door grip base flange (45) is flush against a first body wall (47) of the body (41) of the door latch (11). The spring (18) protrudes from the door grip base (19) and out the opening (42) of the body (41).

Figure 8:
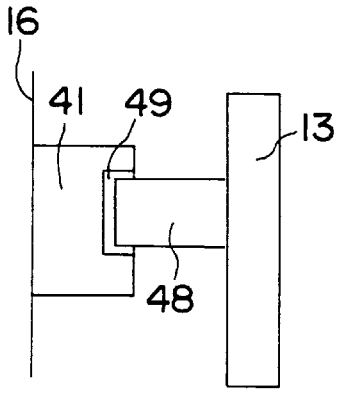
FIG. 8 is a side view of the door latch showing the gap.

As shown in FIG. 4, the knob (13) is attached to a generally "L" shaped base (48) and is movable laterally by all application of lateral force to the knob (13). The "L" shaped base (48) of the knob (13) is contained within the body (41) of the door latch (11) with the foot of the "L" (50) ill contact with the top of the body (41) of the door latch (11). A gap (49) is formed, as shown in FIG. 8, between the knob (13) and the body (41) of the door latch (11). Through the gap (49) the door grip (14) is inserted with the spring (18) protruding from the opening (42) ill the body (41).

In a closed and locked position, the door grip (14) is engaged with the base grip (15). A lateral force (39) is applied by the operator to the knob (13) thereby causing the foot (50) of the "L" shaped base (48) of the knob (13) to exert force on the bottom of the door latch. The spring (18) is biased against the door (7) and exerts a force against the door grip extension (43) so as to lift the door grip (14) away from the door (7). This lifting of the door grip (14) thereby disengages the lip of the door grip (14) from the lip of the base grip (15). The door is now unlocked and upon further exertion of lateral force the door (7) is rolled up the inclined track (1).

I claim:

1. A self-closing and self-locking sliding door having an inside door surface and an outside door surface, the door is acted upon by the force of gravity and mounted within a wall having a generally rectangular opening defined by opposed top and bottom sides and generally opposed first and second vertical sides, said door comprising;

a header attached to the top side of the generally rectangular opening in the wall;

a track mounted to the header;

a track mounting means fixedly mounting the track to the header;

a roller block assembly seated on said track;

a door mechanism attached to the roller block assembly;

a roller fastening means for fastening, the door mechanism to the roller block assembly; and a locking mechanism including, a door latch attached to the inside surface of the door, a door latch attachment means for securing, the door latch to the door, a base latch attached to the first vertical side of the generally rectangular opening in the wall, and a base latch attachment means for securing the base latch to the first vertical side.

2. The door of claim 1, wherein the door mechanism further comprises a frame, a window, and a mounting flange, said frame having opposed upper and lower flame portions and opposed first and second vertical frame portions, said window encompassed within the upper, lower, first vertical, and second vertical portions of the frame and said mounting flange protrudes from the upper frame portion mounting the door mechanism to the roller block assembly.

3. The door of claim 1, wherein the header is "U" shaped and further comprises a first top horizontal side, a vertical base, and a second bottom horizontal side, said first top horizontal side is attached to the top side of the rectangular opening of the wall said vertical base is attached to the first top horizontal side, said second bottom horizontal side is attached to the vertical base and includes an indoor header flange for attachment to the track, said header flange protrudes from said second bottom horizontal side and is parallel to the vertical base of the "U" shape header.

4. The door of claim 1, wherein said door mechanism further comprises a mounting flange, and said roller block assembly further comprises a block and a concave roller, said block includes a first face adjacent to the mounting flange and a second face adjacent to the concave roller.

5. The door of claim 1 wherein said door mechanism further comprises a mounting flange, said roller block assembly further comprises a block and a concave roller, and said roller fastening means further comprises a bolt and a hexagonal nut, said mounting flange, block, and concave roller each include a respective opening, each of said openings coaxial with each other, said bolt includes a head end and a tail end, said bolt is inserted through said openings in said block, concave roller and mounting flange, wherein said head end of said bolt is adjacent to the mounting flange and said tail end of said bolt protrudes from the opening in the concave roller, said hexagonal nut is fastened to the tail end of the bolt thereby securing the block and concave roller to the mounting flange.

6. The door of claim 1, wherein the track is inclined and further comprises a vertical track flange for attachment to the header, a horizontal base attached to the vertical track flange, and a track roller support attached to the horizontal base and parallel to the vertical track flange, said track roller support has a convex track roller support surface at end opposite the end attached to the horizontal base.

7. The door of claim 6, wherein the track mounting means further comprises a riveting means for attaching the vertical track flange to the header, and an insulator positioned between said vertical track flange and said header.

8. The door of claim 1, further comprising a sill with a downward slope mounted between the header and the door mechanism.

9. A sell-closing and self-locking sliding door having an inside door surface and an outside door surface, said door acted upon by the force of gravity and mounted within a wall having a generally rectangular opening defined by opposed top and bottom sides and generally opposed first and second vertical sides, said door comprising:

a header attached to the top side of the rectangular opening in the wall;

a track mounted to the header;

a track mounting means fixedly mounting the track to the header;

a roller block assembly seated on said track;

a door mechanism fastened to the roller block assembly, said door mechanism including a frame;

a roller fastening means for fastening the door mechanism to the roller block assembly;

a cover attached to the top side of the rectangular opening wall and to the frame of the door mechanism;

a door latch attached to the inside surface of the door, includes a knob, an "L" shaped base, a door grip, a body, a spring, and a door stand; and a base latch attached to the first vertical side of the rectangular opening wall includes a base grip;

said door stand attached to the inside surface of said door and said body attached to said door stand;

said "L") shaped base includes a foot section and said knob attached to said "L" shaped base at an end opposite the foot section, said body accommodates said foot section and said body includes a first body wall;

said door grip includes a door grip extension and a door grip base, said door grip extension contained within said body adjacent the foot section of the "L" shaped base, and said door grip base coextensive with the first body wall of the body and maintains the door grip extension within the body;

said spring contained within the body biasing the door grip extension toward the foot section of the "L" shaped base and urging the door grip to contact the base grip in a locked position;

wherein upon a force applied to the knob in a door opening direction, the "L" shaped base urges the foot section against the door grip extension and biasing spring, releasing the door grip from locked engagement with the base grip.

* * * * *